US009751319B2

(12) United States Patent
Chen et al.

(10) Patent No.: US 9,751,319 B2
(45) Date of Patent: *Sep. 5, 2017

(54) PRINTING FLUID CARTRIDGE

(71) Applicant: HEWLETT-PACKARD DEVELOPMENT COMPANY, L.P., Houston, TX (US)

(72) Inventors: Chien-Hua Chen, Covallis, OR (US); Michael W. Cumbie, Covallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/364,034

(22) Filed: Nov. 29, 2016

(65) Prior Publication Data

US 2017/0080715 A1 Mar. 23, 2017

Related U.S. Application Data

(63) Continuation of application No. 14/770,762, filed as application No. PCT/US2013/074925 on Dec. 13, 2013, now Pat. No. 9,539,814.

(30) Foreign Application Priority Data

Feb. 28, 2013 (WO) ..... PCT/US2013/028216
Jun. 17, 2013 (WO) ..... PCT/US2013/046065

(51) Int. Cl.
*B41J 2/16* (2006.01)
*B41J 2/175* (2006.01)
(Continued)

(52) U.S. Cl.
CPC ..... *B41J 2/17526* (2013.01); *B41J 2/1433* (2013.01); *B41J 2/14072* (2013.01);
(Continued)

(58) Field of Classification Search
CPC .. B41J 2/17526; B41J 2/17553; B41J 2/1637; B41J 2/14072; B41J 2/1433; B41J 2/14145
See application file for complete search history.

(56) References Cited

U.S. PATENT DOCUMENTS 4,633,274 A 12/1986 Matsuda
4,873,622 A 10/1989 Komuro et al.
(Continued)

FOREIGN PATENT DOCUMENTS

DE 102011084582 2/2013
EP 1095773 5/2001
(Continued)

OTHER PUBLICATIONS

International Search Report & Written Opinion received for PCT Application No. PCT/US2013/074925, Mar. 20, 2014, 14 pages.
(Continued)

*Primary Examiner* — Jason Uhlenhake
(74) *Attorney, Agent, or Firm* — HP Inc.—Patent Department

(57) ABSTRACT

In some examples, printing fluid cartridge comprises a housing and an assembly supported by the housing. The assembly comprises a molding, a fluid dispensing die having a front part comprising an orifice to dispense printing fluid from the fluid dispensing die, the fluid dispensing die embedded in the molding that comprises a channel to pass fluid to a back part of the fluid dispensing die, the front part of the fluid dispensing die exposed outside the molding and the back part of the fluid dispensing die covered by the
(Continued)

molding except at the channel. The assembly further comprises a first external electrical contact electrically connected to the fluid dispensing die and exposed outside the molding to connect to circuitry external to the assembly, and a non-fluid dispensing die electronic device buried in the molding and electrically connected to the first external electrical contact.

19 Claims, 19 Drawing Sheets

(51) Int. Cl.
*B41J 2/14* (2006.01)
*B41J 2/155* (2006.01)

(52) U.S. Cl.
CPC ..... *B41J 2/14145* (2013.01); *B41J 2/155* (2013.01); *B41J 2/1601* (2013.01); *B41J 2/1603* (2013.01); *B41J 2/1607* (2013.01); *B41J 2/1628* (2013.01); *B41J 2/1637* (2013.01); *B41J 2/17553* (2013.01); *B41J 2002/14362* (2013.01); *B41J 2002/14419* (2013.01); *B41J 2202/20* (2013.01)

(56) References Cited

U.S. PATENT DOCUMENTS

| | | | |
|---|---|---|---|
| 6,145,965 | A | 11/2000 | Inada et al. |
| 6,250,738 | B1 | 6/2001 | Waller et al. |
| 6,554,399 | B2 | 4/2003 | Wong et al. |
| 6,896,359 | B1 | 5/2005 | Miyazaki et al. |
| 7,490,924 | B2 | 2/2009 | Haluzak et al. |
| 7,498,666 | B2 | 3/2009 | Hussa |
| 7,591,535 | B2 | 9/2009 | Nystrom et al. |
| 7,658,470 | B1 | 2/2010 | Jones et al. |
| 7,824,013 | B2 | 11/2010 | Chung-Long-Shan et al. |
| 7,877,875 | B2 | 2/2011 | O'Farrell et al. |
| 8,197,031 | B2 | 6/2012 | Stephens et al. |
| 8,235,500 | B2 | 8/2012 | Nystrom et al. |
| 8,246,141 | B2 | 8/2012 | Petruchik et al. |
| 8,272,130 | B2 | 9/2012 | Miyazaki |
| 8,287,104 | B2 | 10/2012 | Sharan et al. |
| 8,342,652 | B2 | 1/2013 | Nystrom et al. |
| 8,476,748 | B1 | 7/2013 | Darveaux et al. |
| 2002/0030720 | A1 | 3/2002 | Kawamura et al. |
| 2002/0122097 | A1 | 9/2002 | Beerling et al. |
| 2002/0180825 | A1 | 12/2002 | Buswell et al. |
| 2004/0032468 | A1 | 2/2004 | Killmeier et al. |
| 2005/0024444 | A1 | 2/2005 | Conta et al. |
| 2006/0209110 | A1 | 9/2006 | Vinas et al. |
| 2006/0280540 | A1 | 12/2006 | Han |
| 2007/0153070 | A1 | 7/2007 | Haines et al. |
| 2008/0079781 | A1 | 4/2008 | Shim et al. |
| 2008/0259125 | A1 | 10/2008 | Haluzak et al. |
| 2009/0225131 | A1 | 9/2009 | Chen et al. |
| 2010/0271445 | A1 | 10/2010 | Sharan et al. |
| 2011/0019210 | A1 | 1/2011 | Chung et al. |
| 2011/0037808 | A1 | 2/2011 | Ciminelli et al. |
| 2011/0080450 | A1 | 4/2011 | Ciminelli et al. |
| 2011/0141691 | A1 | 6/2011 | Slaton et al. |
| 2011/0222239 | A1 | 9/2011 | Dede |
| 2011/0292126 | A1 | 12/2011 | Nystrom et al. |
| 2011/0298868 | A1 | 12/2011 | Fielder et al. |
| 2012/0019593 | A1 | 1/2012 | Scheffelin et al. |
| 2012/0061857 | A1 | 3/2012 | Ramadoss et al. |
| 2012/0098114 | A1 | 4/2012 | Ishibashi |
| 2012/0124835 | A1 | 5/2012 | Okano et al. |
| 2012/0186079 | A1 | 7/2012 | Ciminelli |
| 2012/0210580 | A1 | 8/2012 | Dietl |
| 2012/0212540 | A1 | 8/2012 | Dietl |

FOREIGN PATENT DOCUMENTS

| | | |
|---|---|---|
| JP | 2001071490 | 3/2001 |
| JP | 2000108360 | 4/2001 |
| JP | 2006321222 | 11/2006 |
| JP | 2010137460 | 6/2010 |
| TW | 501979 | 9/2002 |
| TW | 503181 | 9/2002 |
| WO | WO-2012134480 | 10/2012 |

OTHER PUBLICATIONS

Kumar, Aditya et al.,Wafer Level Embedding Technology for 3D Wafer Level Embedded Package, Institute of Microelectronics, A *Star; 2Kinergy Ltd, TECHplace II; Electronic Components and Technology Conference, 2009 (9 pages).

Lee et al; A Thermal Inkjet Printhead with a Monolithically Fabricated Nozzle Plate and Self-aligned Ink Feed Hole; Journal of Microelectromechanical Systems; vol. 8, No. 3; Sep. 1999; pp. 229-236.

Lindemann, T. et al., One Inch Thermal Bubble Jet Printhead with Laser Structured Integrated Polyimide Nozzle Plate; http://ieeexplore.ieee.org/stamp/stamp.jsp?tp=&arnumber=4147592 > vol. 16; Issue: 2; Apr. 2007, pp. 420-428.

Yim, M.J. et al.; Ultra Thin Pop Top Package Using Compression Mold;it's Warpage Contorl; http://ieeexplore.ieee.org/xpl/articleDetails.jsp?tp=&arnumber=5898654&gueryText%3D mold+cap+thick* > May 31-Jun. 3, 2011, pp. 1141-1146.

PRINTING FLUID CARTRIDGE

CROSS REFERENCE TO RELATED APPLICATIONS

This is a continuation of U.S. application Ser. No. 14/770,762, filed Aug. 26, 2015, which is a national stage application under 35 U.S.C. §371 of PCT/US2013/074925, filed Dec. 13, 2013, which claims priority from PCT/US2013/028216, filed Feb. 28, 2013, and PCT/US2013/046065, filed Jun. 17, 2013, which are all hereby incorporated by reference in their entirety.

BACKGROUND

Conventional inkjet printheads require fluidic fan-out from microscopic ink dispensing chambers to macroscopic ink supply channels.

DRAWINGS

Figure 2:
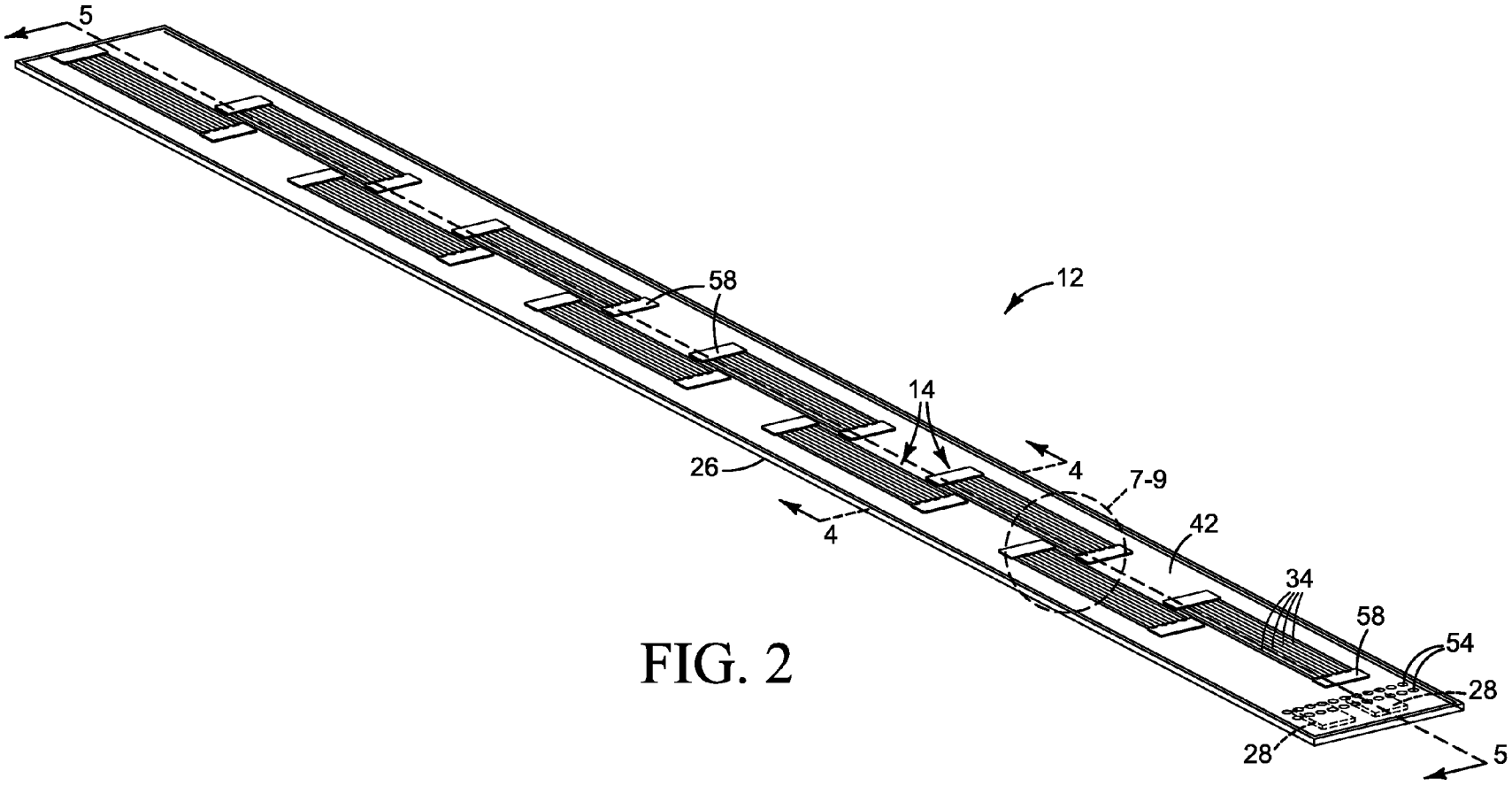
FIGS. 2 and 3 are perspective front and back views, respectively, illustrating one example of a molded print bar such as might be used in the printer shown in FIG. 1.
Figure 4:
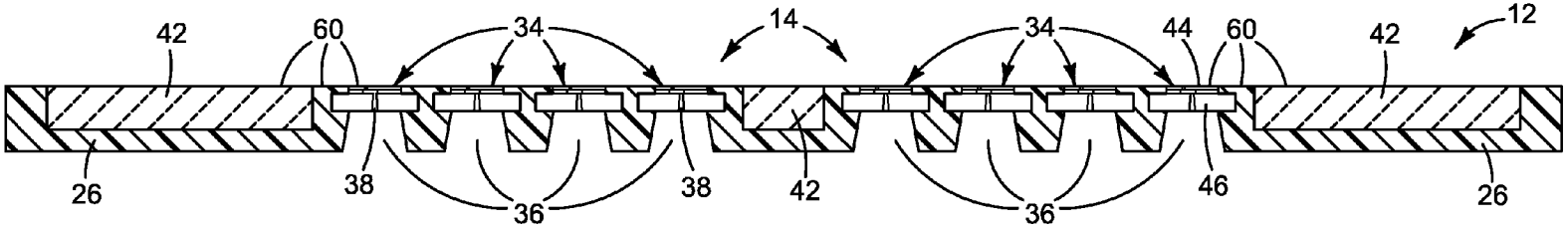
Figure 5:
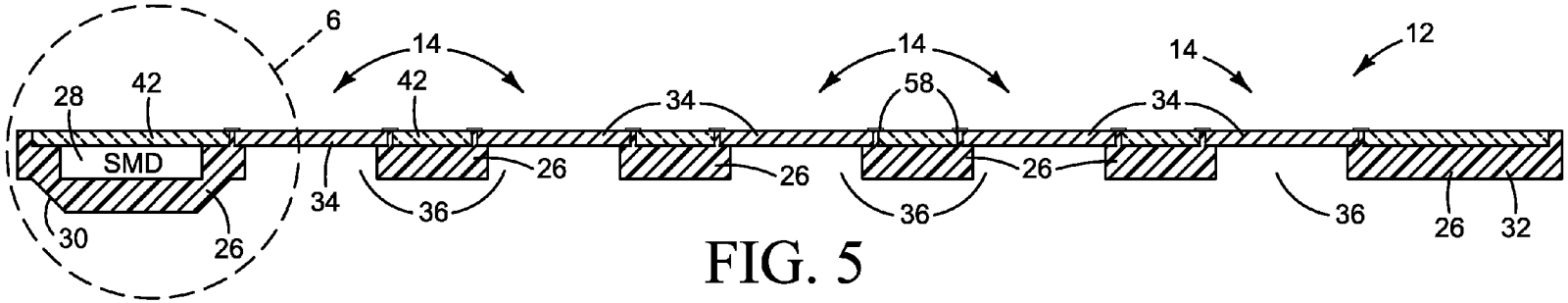

FIGS. 4 and 5 are section views taken along the lines 4-4 and 5-5, respectively, in FIG. 2.

Figure 6:
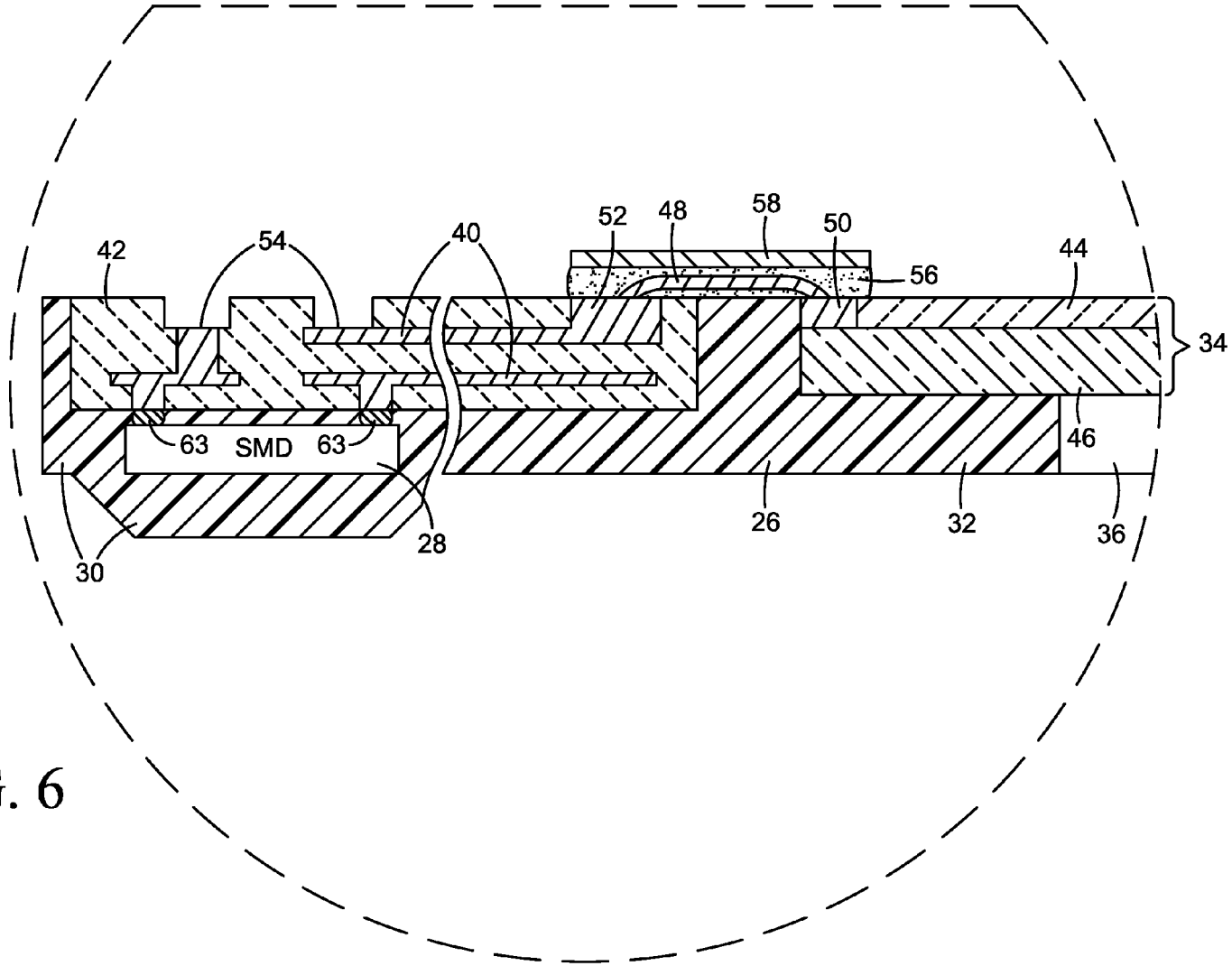

FIG. 6 is a detail from FIG. 5.

Figure 7:
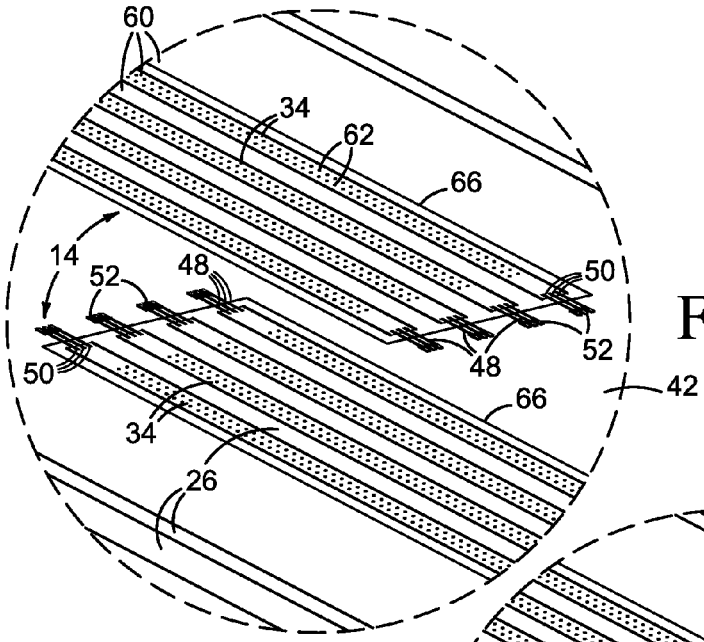
Figure 8:
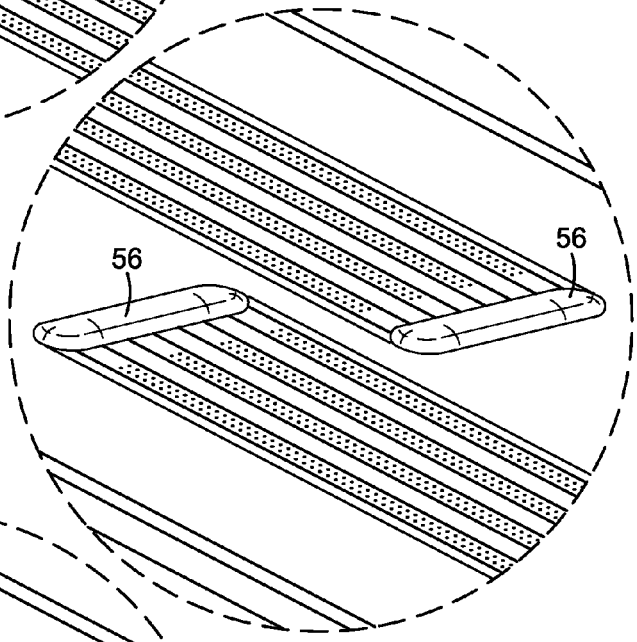
Figure 9:
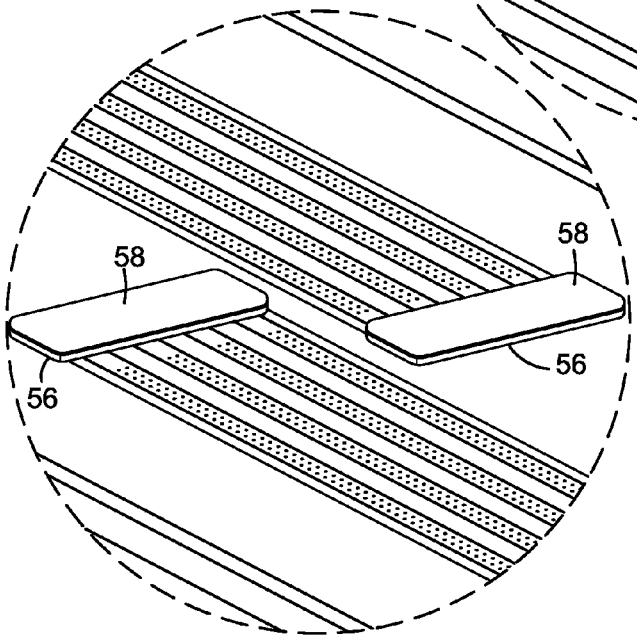

FIGS. 7-9 are details from FIG. 2.

FIGS. 10-17 illustrate one example process for making a molded print bar such as the print bar shown in FIG. 2.

Figure 18:
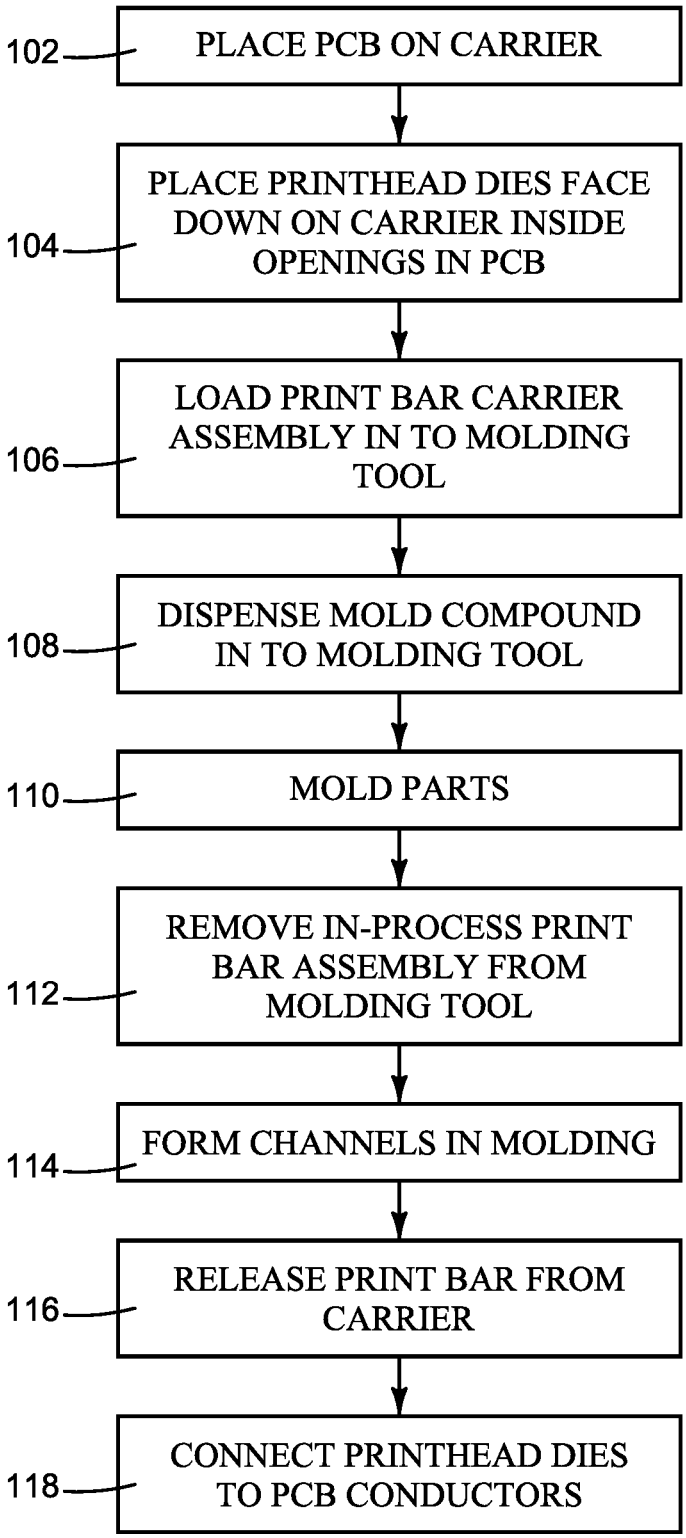

FIG. 18 is a flow diagram of the process illustrated in FIGS. 10-17.

Figure 19:
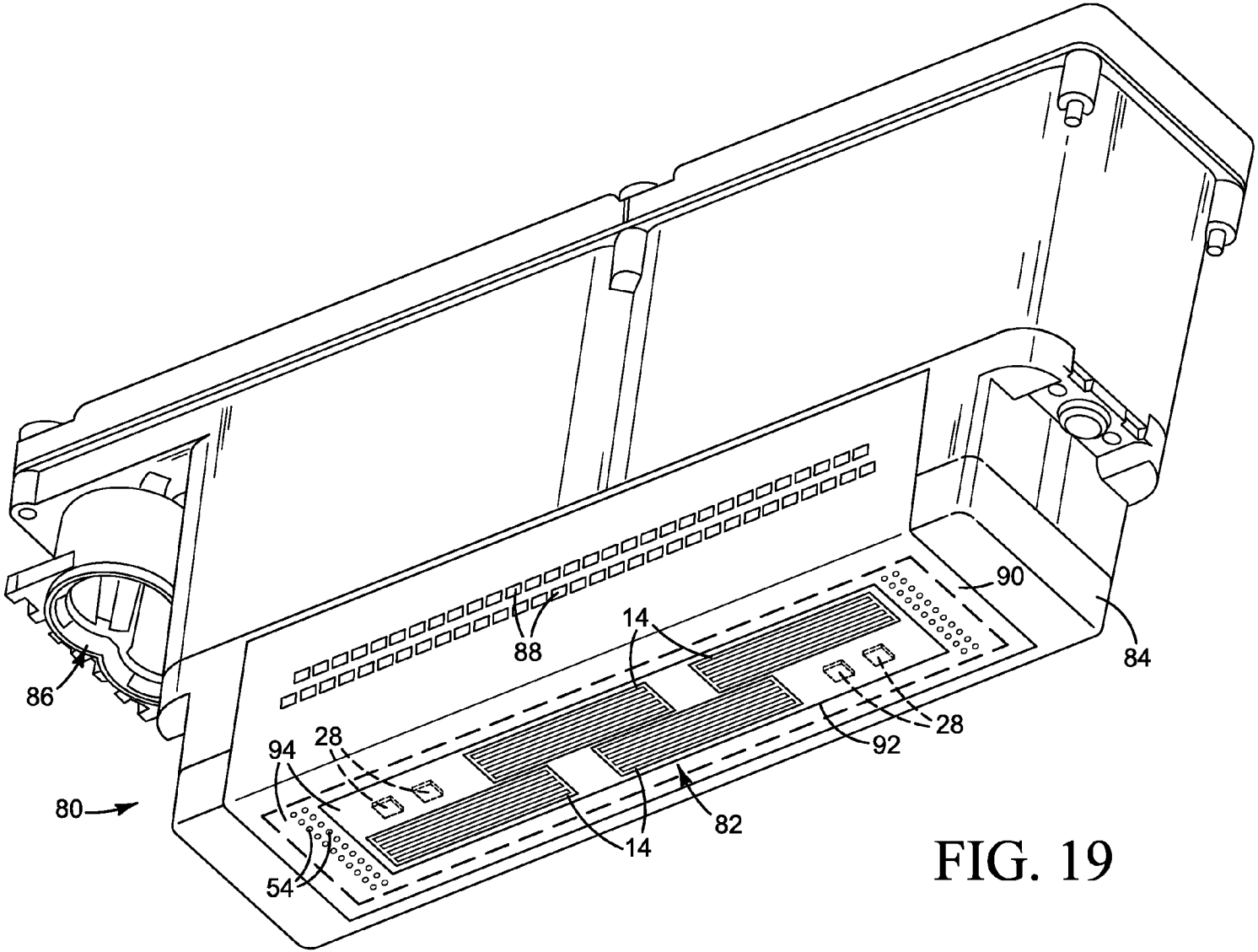

FIG. 19 illustrates an ink cartridge implementing one example of a new molded printhead assembly.

Figure 20:
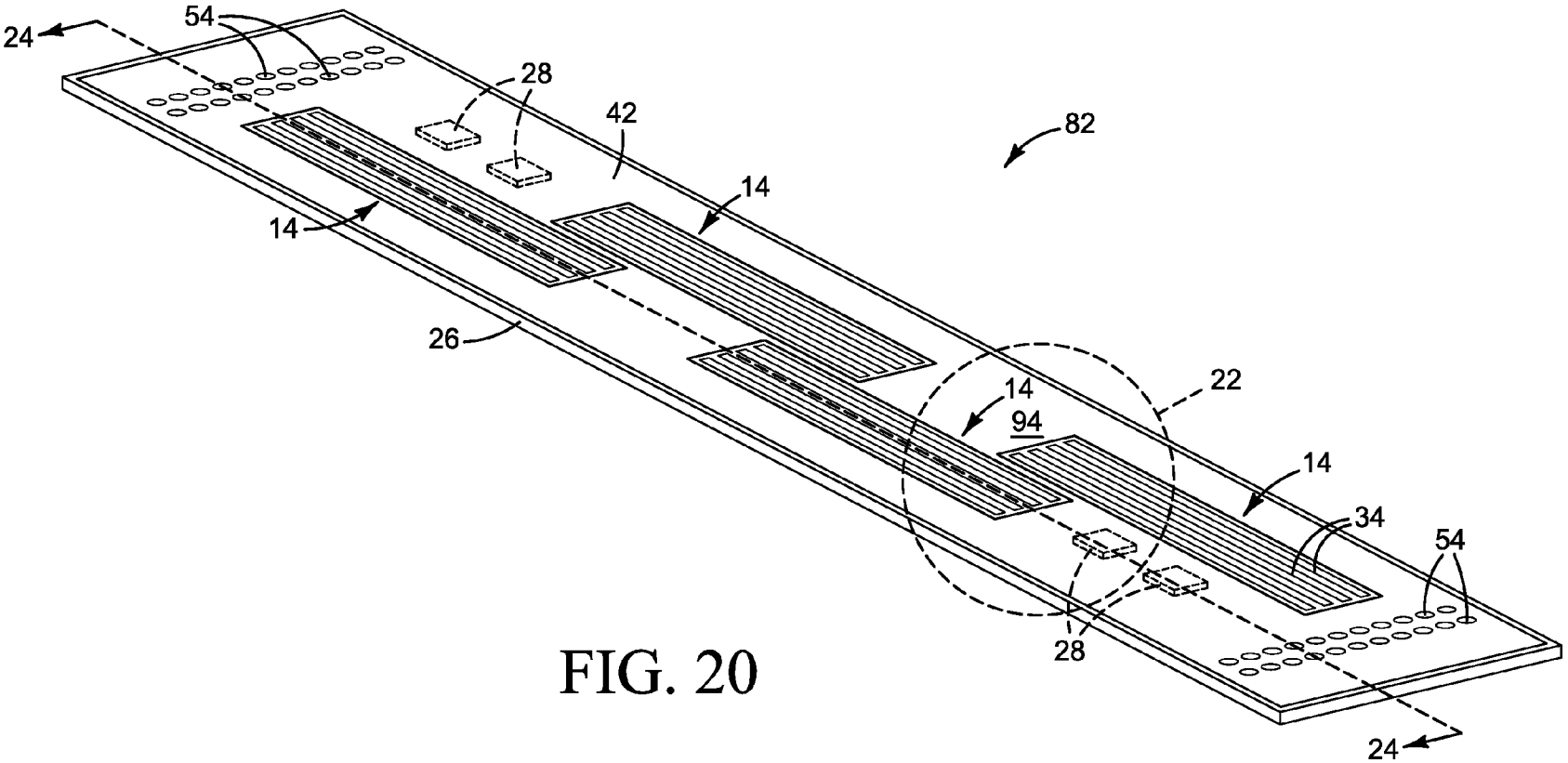
Figure 21:
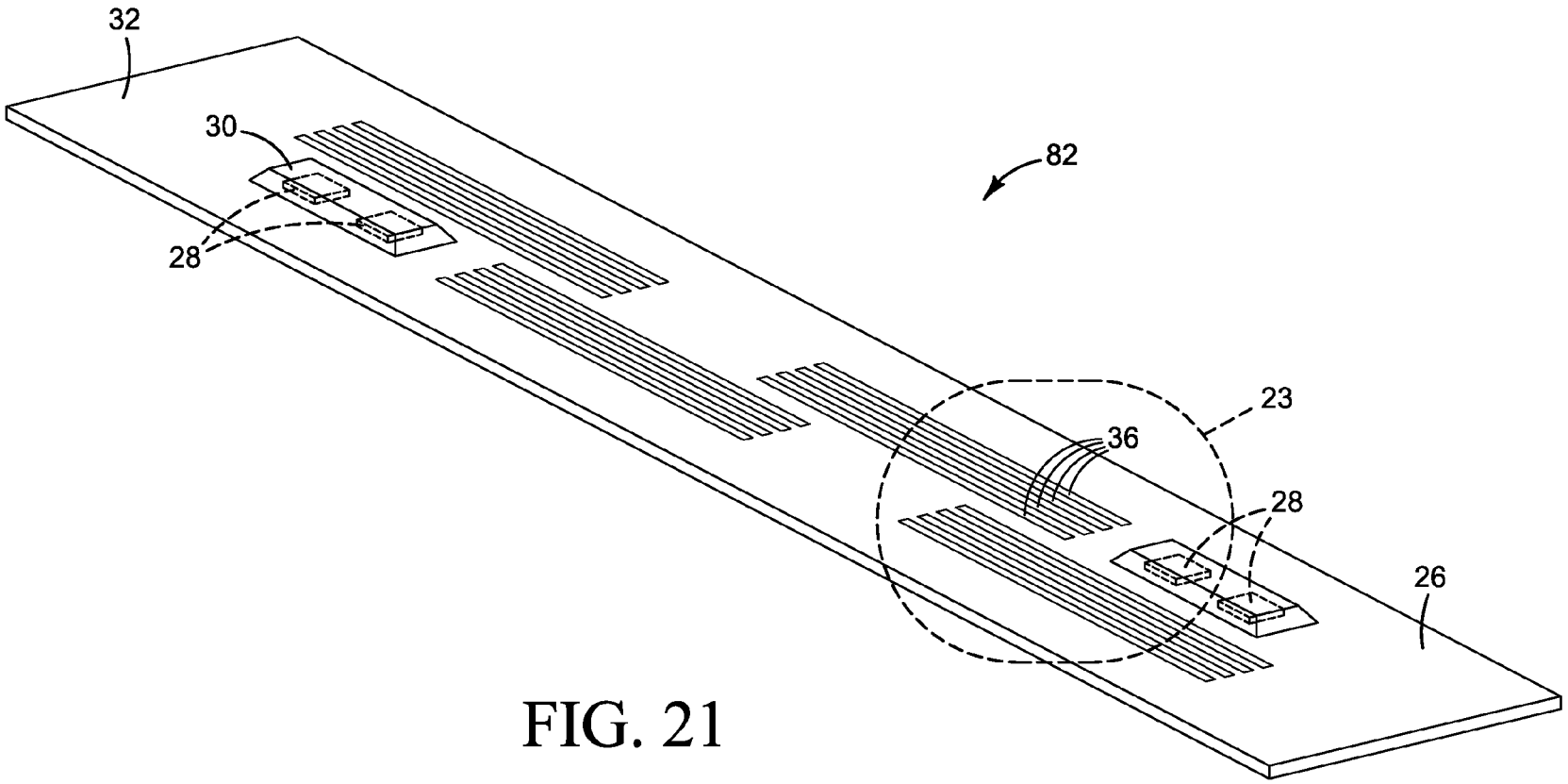

FIGS. 20 and 21 are perspective front and back views, respectively, of the printhead assembly in the ink cartridge shown in FIG. 19.

Figure 22:
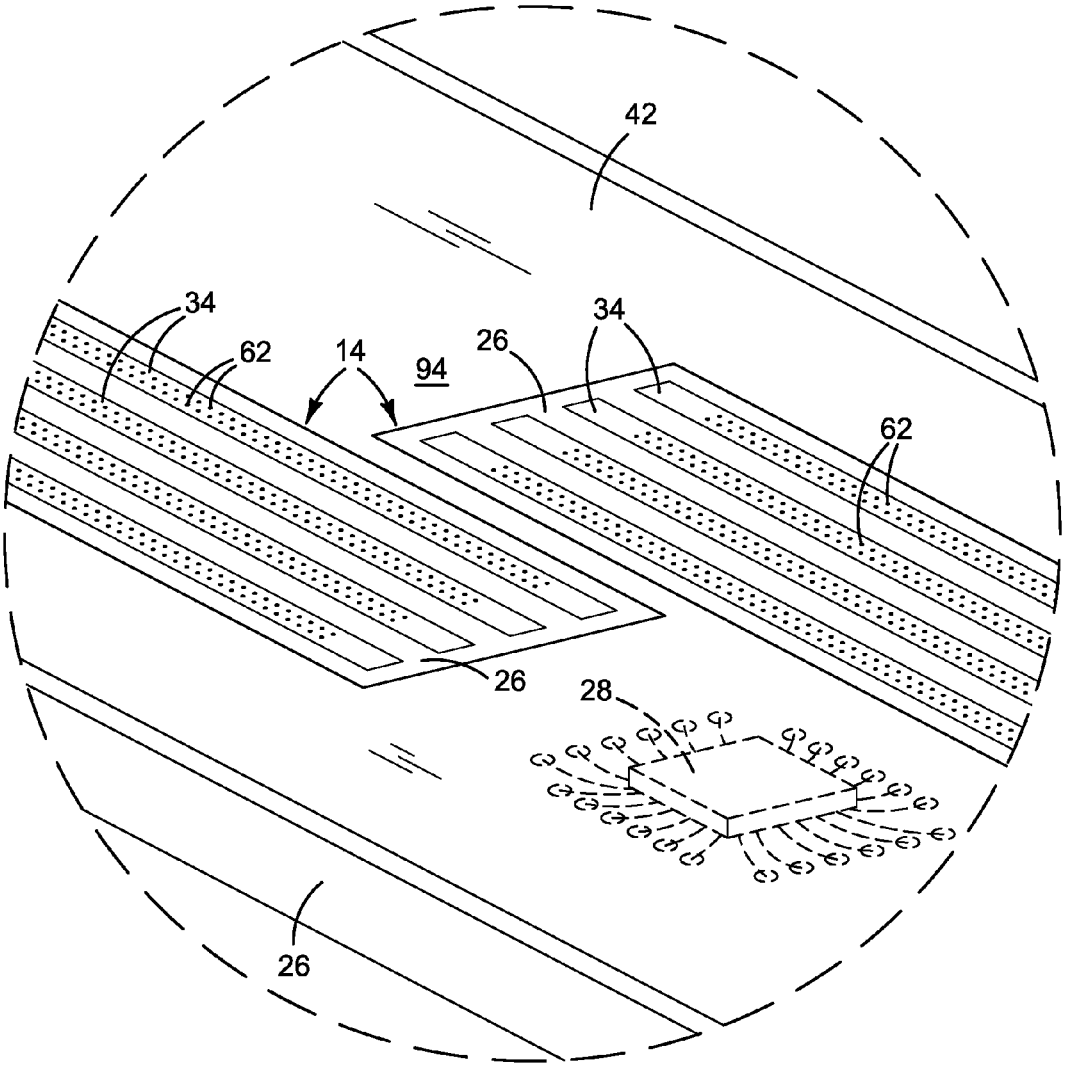

FIG. 22 is a front side detail from FIG. 20.

Figure 23:
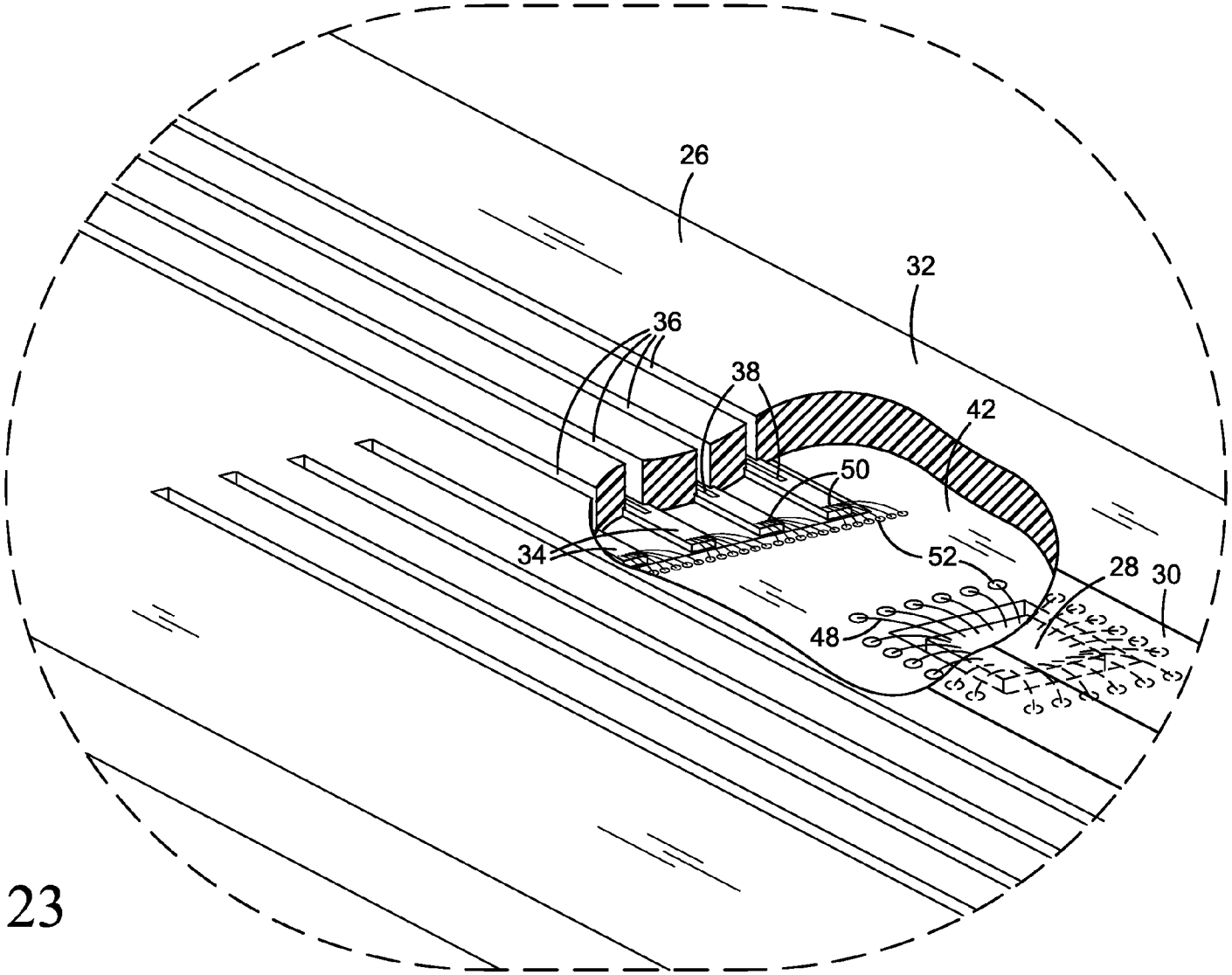

FIG. 23 is a back side detail from FIG. 21.

Figure 24:
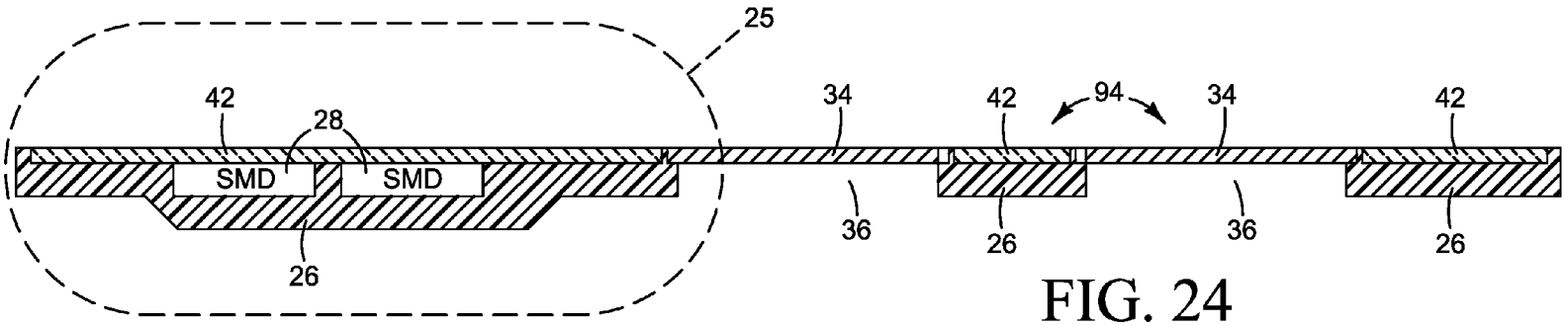

FIG. 24 is a section taken along the line 24-24 in FIG. 20.

Figure 25:
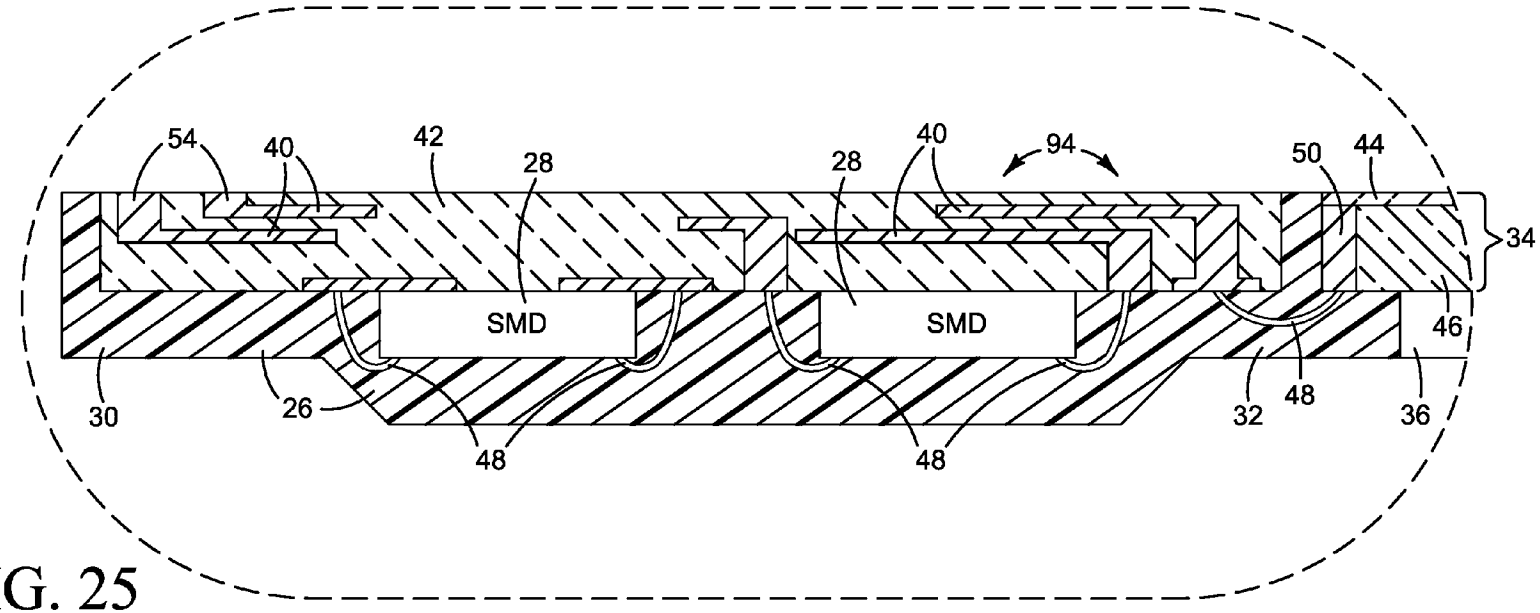

FIG. 25 is a detail from FIG. 24.

The same part numbers designate the same or similar parts throughout the figures. The figures are not necessarily to scale. The relative size of some parts is exaggerated to more clearly illustrate the example shown.

DESCRIPTION

Conventional inkjet printheads require fluidic fan-out from microscopic ink dispensing chambers to macroscopic ink supply channels. Hewlett-Packard Company has developed new, molded inkjet printheads that break the connection between the size of the die needed for the dispensing chambers and the spacing needed for fluidic fan-out, enabling the use of tiny printhead die "slivers" such as those described in international patent application numbers PCT/US2013/046065, filed Jun. 17, 2013 titled Printhead Die, and PCT/US2013/028216, filed Feb. 28, 2013 title Molded Print Bar, each of which is incorporated herein by reference in its entirety. It may be desirable in some printing applications to utilize an ASIC (application specific integrated circuit) in a print bar for high speed input/output between the printer controller and the print bar as well as to perform some logic functions. A conventional integrated circuit packaging process in which the ASIC is flip chip bonded to a molded die package to form a POP (package on package) package does not work well for a molded print bar since there is no UBM (under bump metallization) on the back part of the molding.

Accordingly, a new molded print bar has been developed in which the thickness of the molding varies to accommodate the use of an ASIC in the print bar. The variable thickness molding allows integrating the ASIC into the molding without increasing the thickness of the print bar in the area of the printhead die slivers. A printed circuit board embedded in the molding may be used to connect the ASIC(s) to the printhead dies and to circuitry external to the print bar, and thus avoid the need to form UBM or other wiring in the molding.

Examples of the new variable thickness molding are not limited to print bars or to the use of ASICs, but may be implemented in other printhead structures or assemblies and with other electronic devices. The examples shown in the figures and described herein illustrate but do not limit the invention, which is defined in the Claims following this Description.

As used in this document, a "printhead" and a "printhead die" mean that part of an inkjet printer or other inkjet type dispenser that dispenses fluid, and a die "sliver" means a printhead die with a ratio of length to width of 50 or more. A printhead includes a single printhead die or multiple printhead dies. "Printhead" and "printhead die" are not limited to printing with ink but also include inkjet type dispensing of other fluids and/or for uses other than printing.

Figure 1:
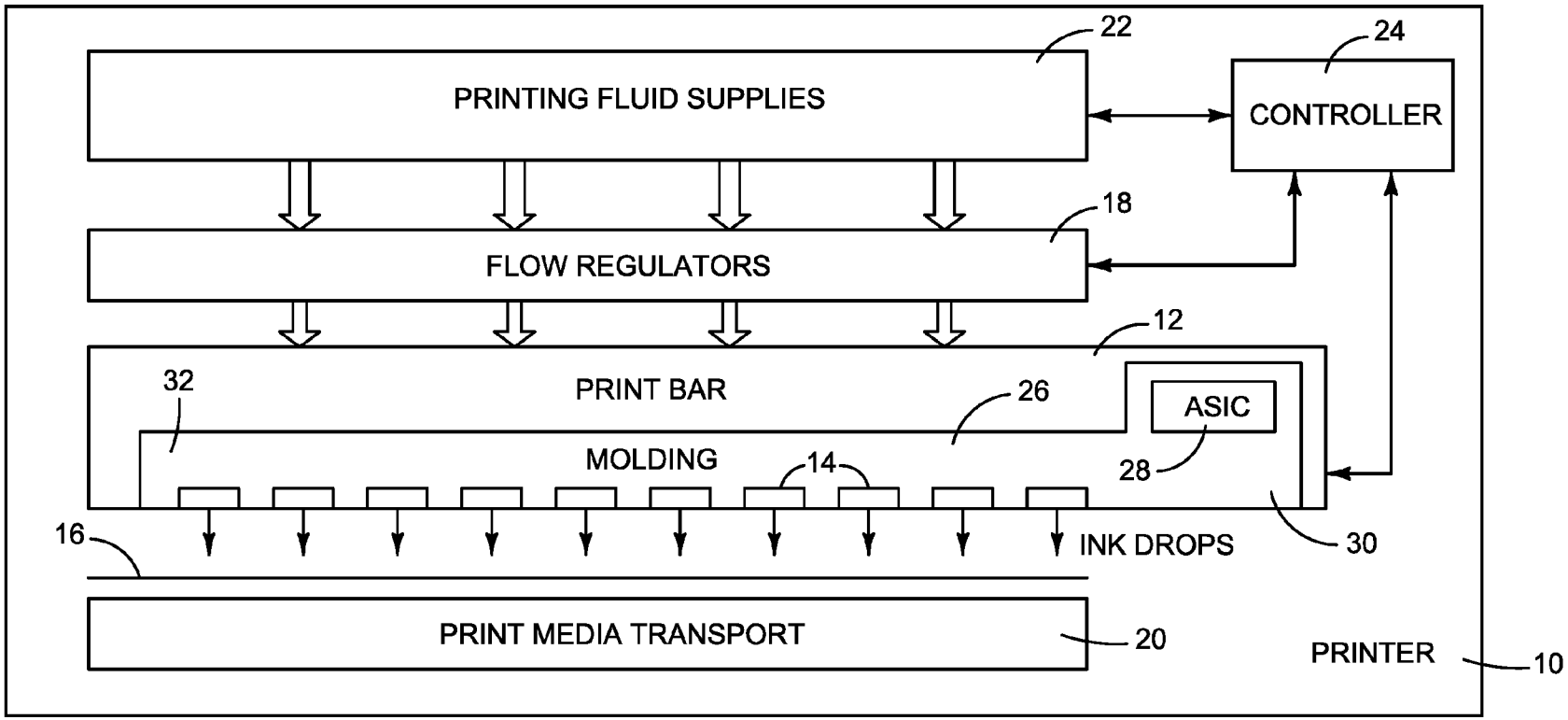
FIG. 1 is a block diagram illustrating an inkjet printer implementing one example of a new molded print bar.

FIG. 1 is a block diagram illustrating an inkjet printer 10 implementing one example of a molded print bar 12. Referring to FIG. 1, printer 10 includes a print bar 12 with an arrangement of printheads 14 spanning the width of a print media 16, flow regulators 18 associated with print bar 12, a print media transport mechanism 20, ink or other printing fluid supplies 22, and a printer controller 24. Controller 24 represents the programming, processor(s) and associated memory(ies), and the electronic circuitry and components needed to control the operative elements of a printer 10. Print bar 12 includes an arrangement of printheads 14 each with a single printhead die or multiple printhead dies embedded in a molding 26 for dispensing printing fluid on to a sheet or continuous web of paper or other print media 16. Print bar 12 also includes an ASIC or other non-printhead die electronic device 28 embedded in molding 26. As described in detail below with reference to FIGS. 4-9, the thickness of molding 26 varies to accommodate ASIC 28 at a thicker part 30 while still maintaining a uniform, thinner part 32 in the print zone spanning the length of printheads 14.

Figure 3:
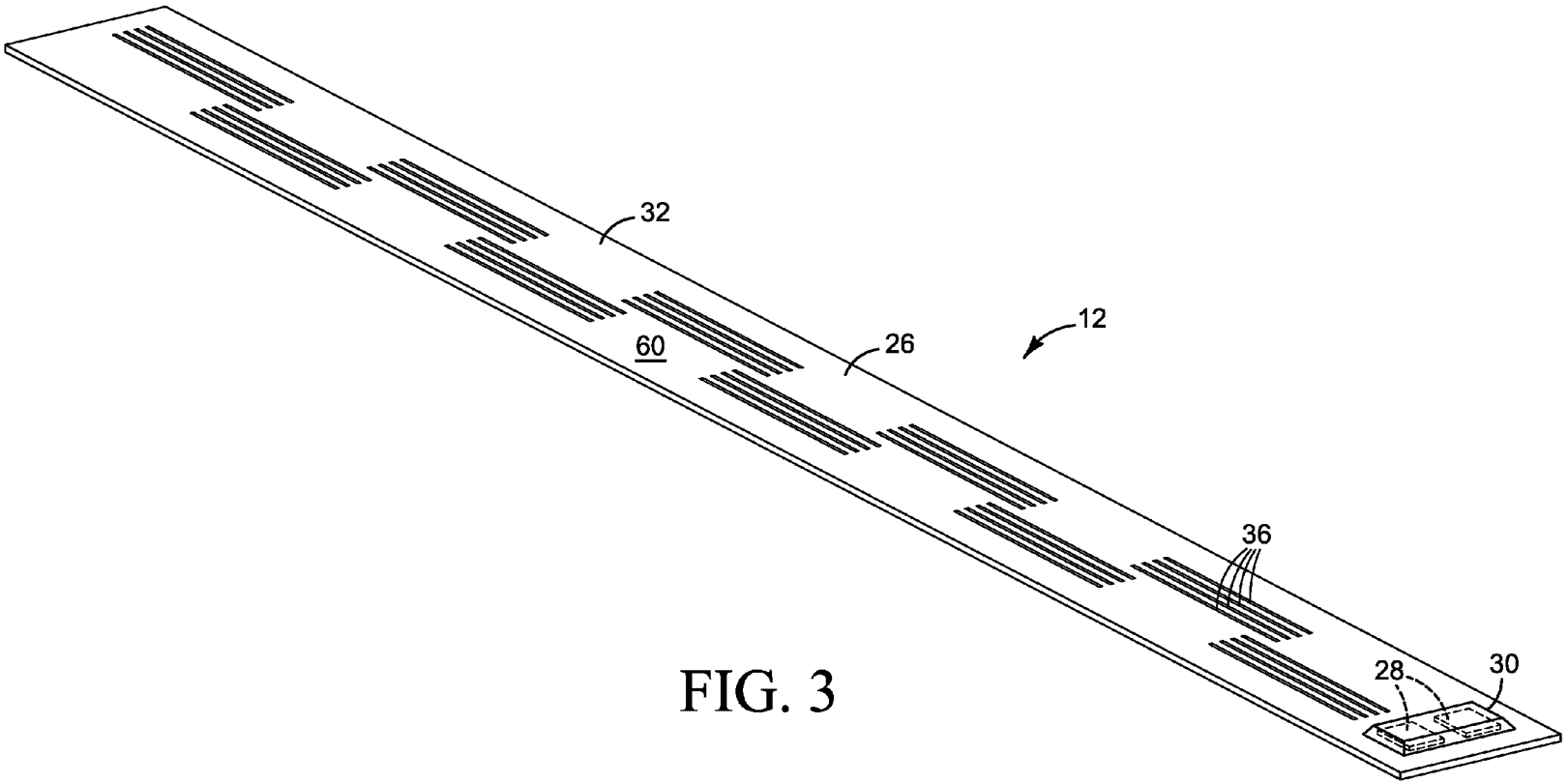

FIGS. 2 and 3 are perspective front and back views, respectively, illustrating one example of a molded print bar 12 such as might be used in printer 10 shown in FIG. 1. FIGS. 4-9 are section and detail views from FIG. 2. (In FIG. 7, the protective coverings on the wire bonds are omitted to show the underlying connections. In FIG. 8, the encapsulant covering the wire bonds is shown and in FIG. 9 the protective cap covering the encapsulant is shown.) Referring to FIGS. 2-9, print bar 12 includes multiple printheads 14 embedded in a monolithic molding 26 and arranged in a row lengthwise along the print bar in a staggered configuration in which each printhead overlaps an adjacent printhead. Although ten printheads 14 are shown in a staggered configuration, more or fewer printheads 14 may be used and/or in a different configuration. Examples are not limited to a media wide print bar. Examples might also be implemented in a scanning type inkjet pen or in a printhead assembly with fewer molded printheads, or even in a single molded printhead.

Each printhead 14 includes printhead dies 34 embedded in molding 26 and channels 36 formed in molding 26 to carry printing fluid directly to corresponding printhead dies 34. In the example shown, as best seen in FIG. 4, channels 36 carry printing fluid directly to inlets 38 at the back part of each die 34. Although four dies 34 arranged parallel to one another laterally across molding 26 are shown for each printhead 14, for printing four different ink colors for example, more or fewer printhead dies 34 and/or in other configurations are possible. As noted above, the development of new, molded inkjet printheads has enabled the use of tiny printhead die "slivers" such as those described in international patent application no. PCT/US2013/046065, filed Jun. 17, 2003 and titled Printhead Die. The molded printhead structures and electrical interconnections described herein are particularly well suited to the implementation of such tiny die slivers 34 in printheads 14.

In the example shown, as best seen in the detail of FIG. 6, the electrical conductors 40 that connect each printhead die 34 to external circuits are routed through a printed circuit board (PCB) 42. A printed circuit board is also commonly referred to as a printed circuit assembly (a "PCA"). Referring specifically to FIG. 6, an inkjet printhead die 34 is a typically complex integrated circuit (IC) structure 44 formed on a silicon substrate 46. PCB conductors 40 carry electrical signals to ejector and/or other elements in the IC part 44 of each die 34. In the example shown, PCB conductors 40 are connected to circuitry in each printhead die 34 through bond wires 48. Each bond wire 48 is connected to bond pads or other suitable terminals 50, 52 at the front part of printhead dies 34 and PCB 42, respectively. Thus, PCB conductors 42 connect printhead dies 34 to exposed contacts 54 for connection to circuits external to print bar 12.

Although other conductor routing configurations are possible, a PCB provides a relatively inexpensive and highly adaptable platform for conductor routing in molded printheads. Similarly, while connectors other than bond wires may be used, bond wire assembly tooling is readily available and easily adapted to the fabrication of printheads 14 and print bar 12. Bond wires 48 may be covered by an epoxy or other suitable protective material 56 as shown in FIGS. 5 and 8. A flat cap 58 may be added as shown in FIG. 9 to form a more flat, lower profile protective covering on bond wires 48. Also, in the example shown, the exposed front part of printhead dies 34 is co-planar with the adjacent surfaces of molding 26 and PCB 42 to present an uninterrupted planar surface 60 surrounding the fluid dispensing orifices 62 in each die 34. (Encapsulant 56 and cap 58 are omitted from FIG. 7 and cap 58 is omitted from FIG. 8 to more clearly show the underlying structures.)

Referring now specifically to FIGS. 2, 3, 5 and 6, print bar 12 includes two non-printhead die electronic devices 28 embedded in molding 26 at the back part of print bar 12. In the example shown, as best seen in FIG. 6, devices 28 are mounted to the back surface of PCB 42 and connected directly to PCB conductors 40 with solder balls 63. Thus devices 28 are denoted in in FIGS. 5 and 6 as surface mounted devices (SMDs) 28. Although other mounting techniques are possible for devices 28, surface mounting is desirable to facilitate molding. Electronic devices 28 that might be integrated into an inkjet print bar 12 include, for example, ASICs, EEPROMs, voltage regulators, and passive signal conditioning devices.

The thickness of molding 26 varies to accommodate SMDs 28 at a thicker part 30 while still maintaining a uniform, thinner part 32 in the print zone spanning the length of printheads 14. That is to say, the profile of molding 26 defines a narrower part 32 along die slivers 34 and a broader part 30 at SMDs 28. While two SMDs 28 are shown in FIGS. 2 and 3, more or fewer devices 28 are possible and/or with other mounting techniques. Also, while devices 28 are positioned at the back of print bar 12 in this example, to allow a substantially flat front print bar surface, it may be desirable in some applications to position devices 28 at the front of print bar 12 or at both the front and back of print bar 12. It is expected that devices 28 will usually be positioned at one end of the print bar to help maintain a uniform, thinner part 32 of molding 26 in the print zone covering the area of fluid dispensing orifices 62.

Figure 10:
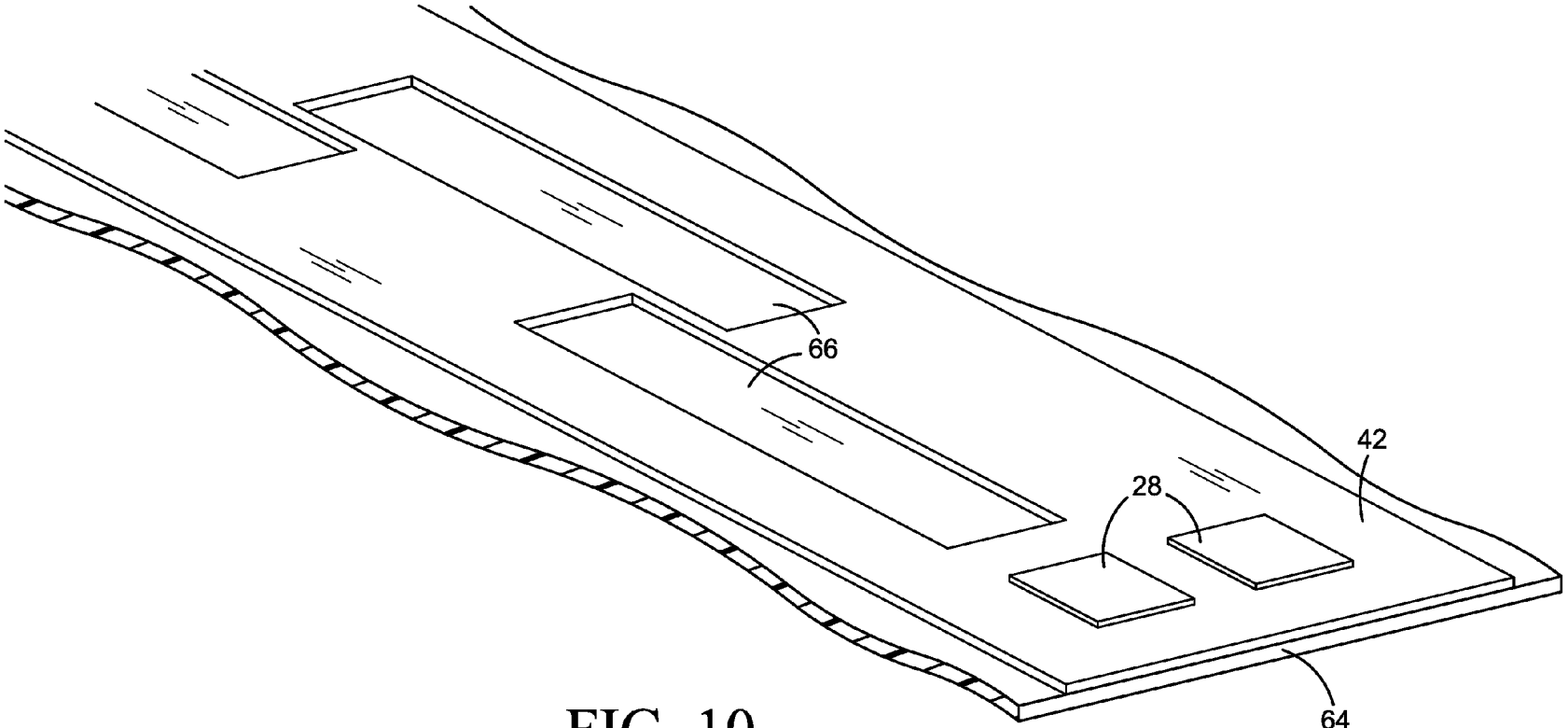
Figure 11:
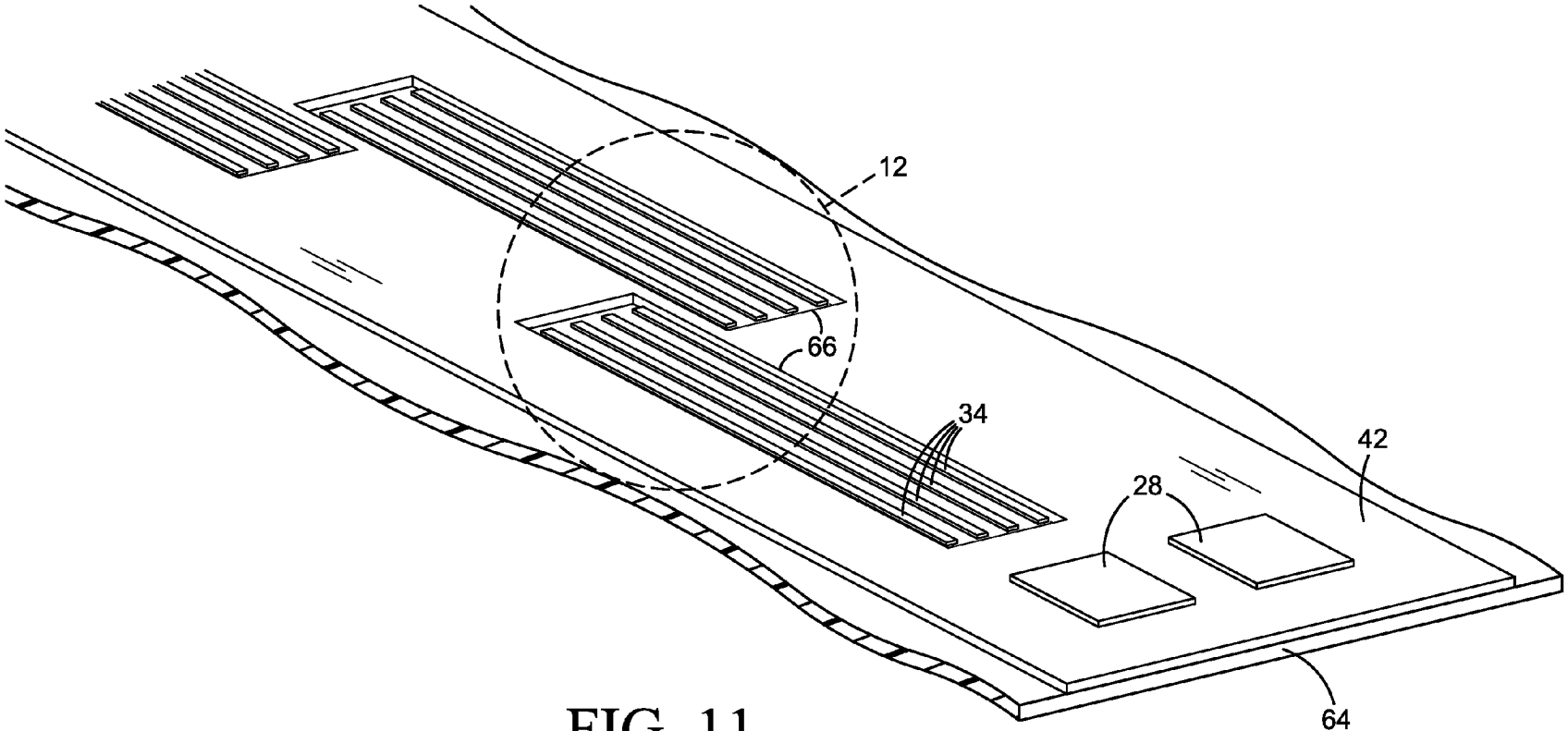
Figure 12:
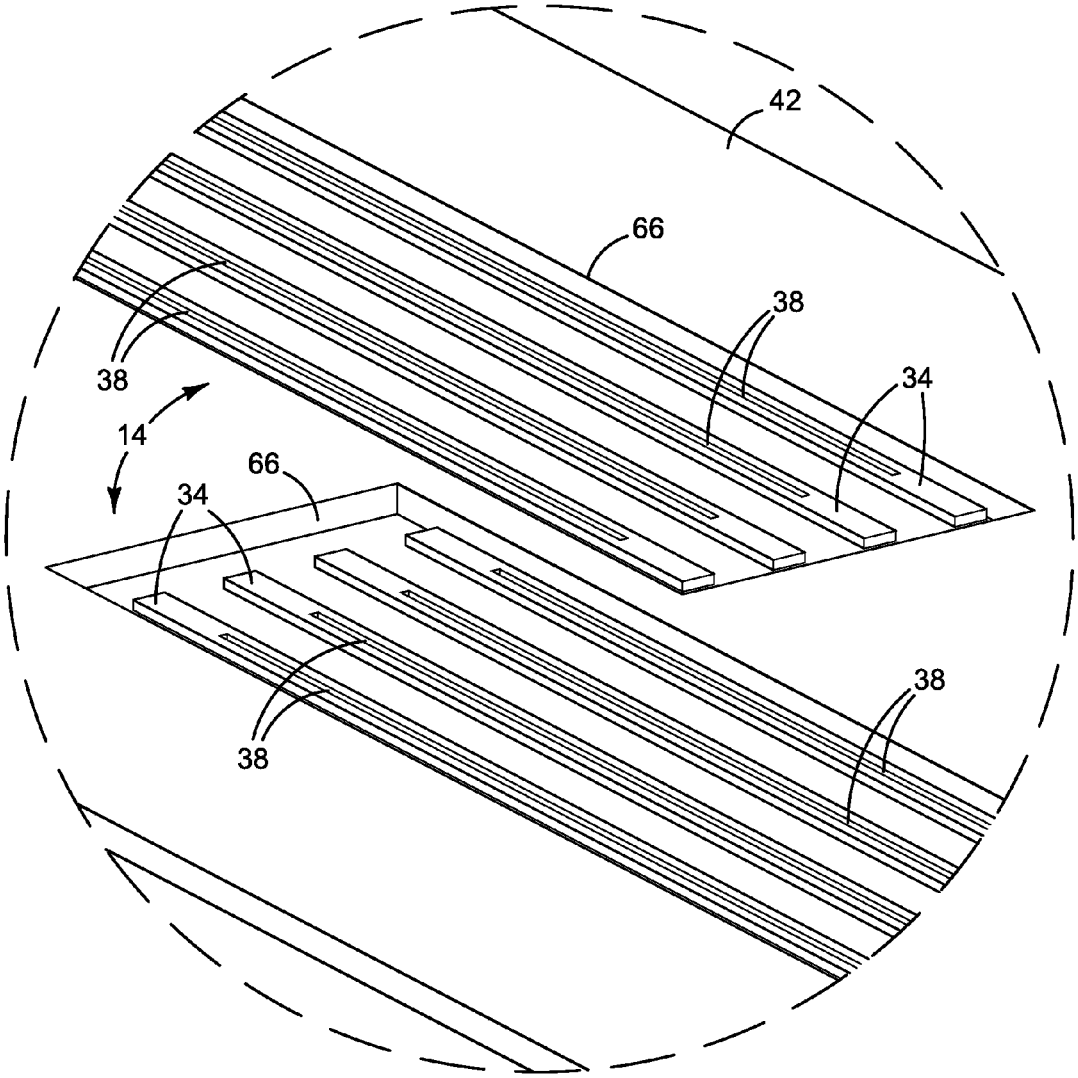

One example process for making a print bar 12 will now be described with reference to FIGS. 10-17 and the flow diagram of FIG. 18. Referring first to FIG. 10, a PCB 42 pre-populated with SMDs 28 is placed on a carrier 64 with a thermal tape or other suitable releasable adhesive (step 102 in FIG. 18). Then, as shown in FIGS. 11 and 12, printhead dies slivers 34 are placed face down on carrier 64 inside openings 66 in PCB 42 (step 104 in FIG. 18). It is expected that multiple print bars will be laid out and molded together on a carrier wafer or panel 64 and singulated into individual print bars after molding. However, only a portion of a carrier panel 64 with part of one print bar in-process is shown in FIGS. 10-12.

Figure 13:
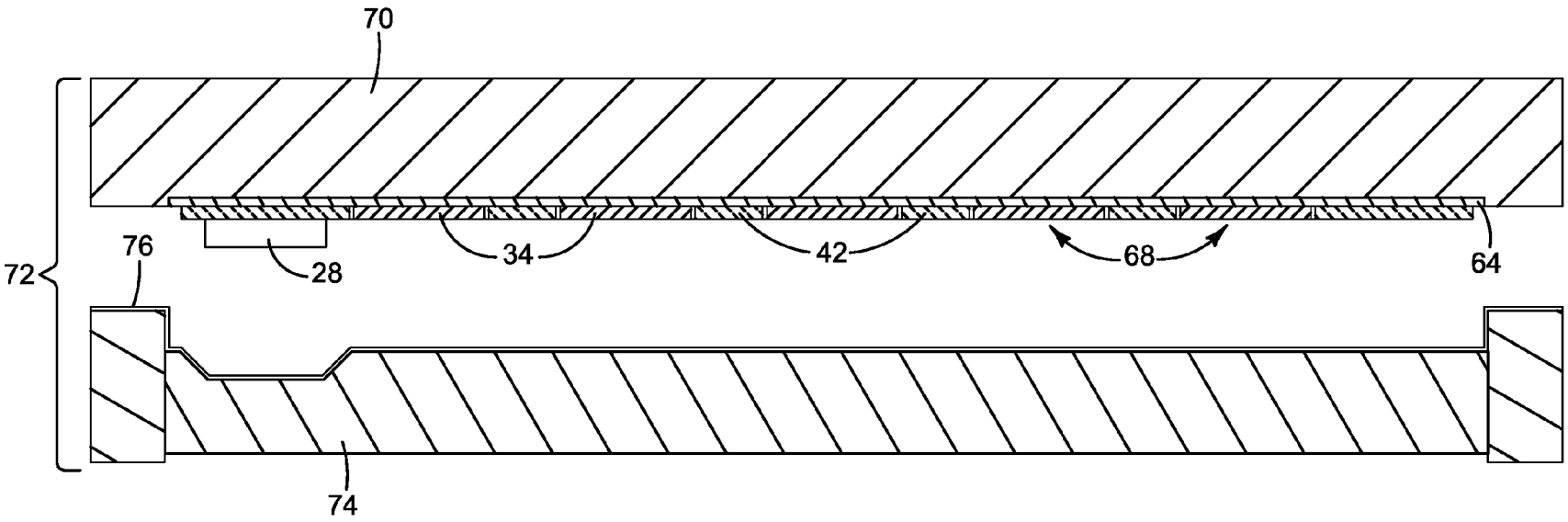
Figure 14:
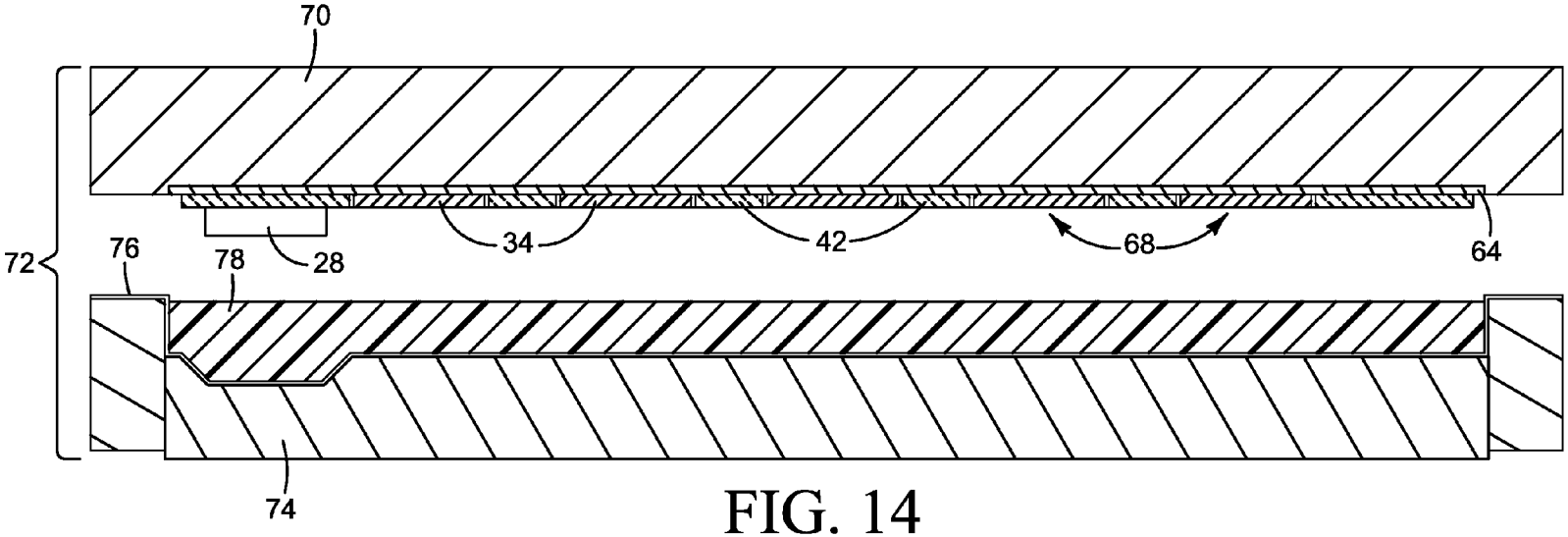
Figure 15:
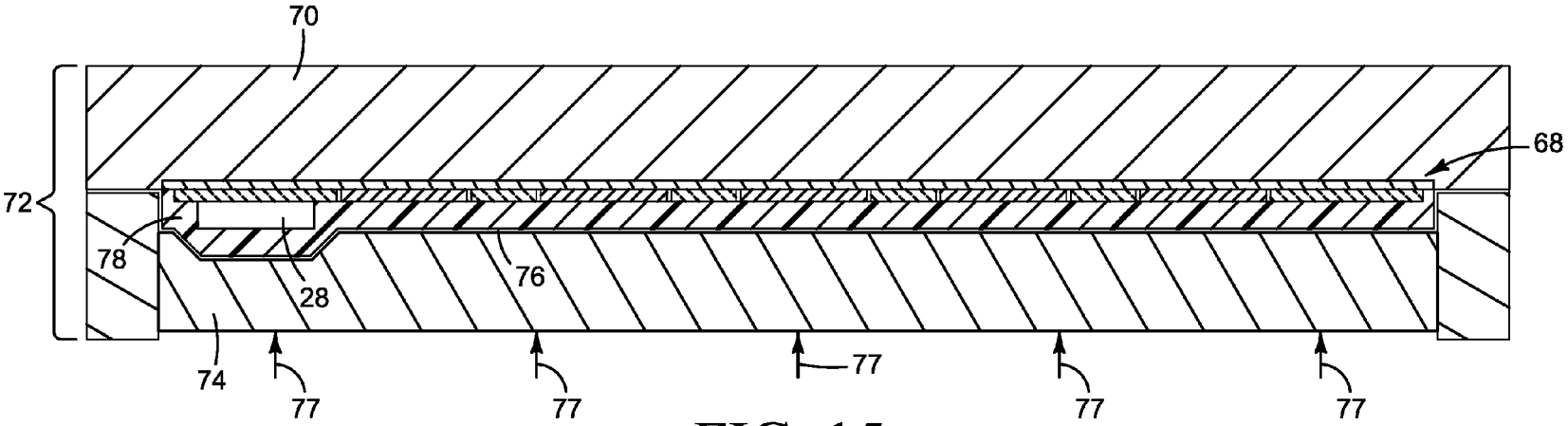
Figure 16:
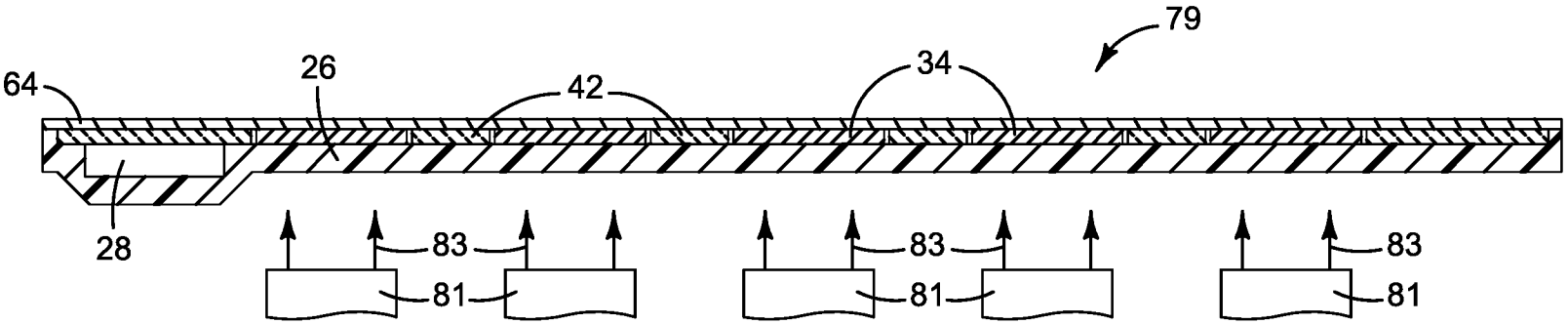
Figure 17:
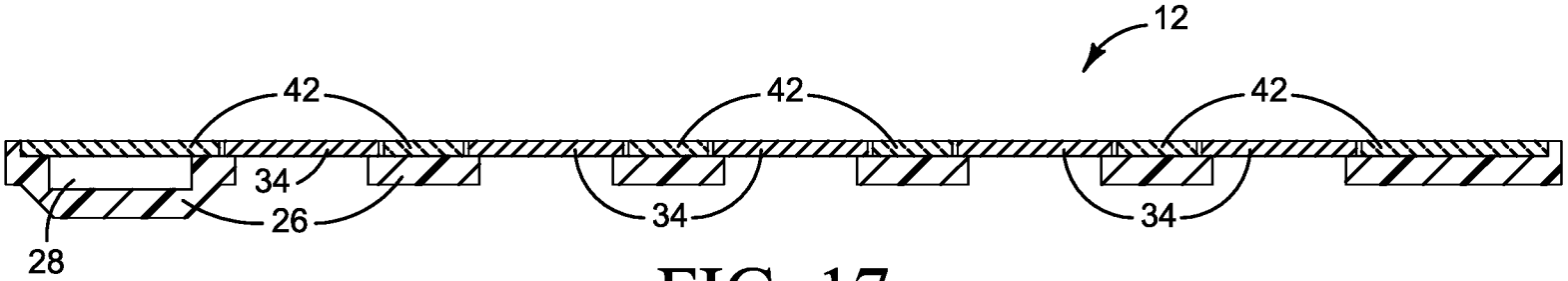

Referring to FIG. 13, the print bar carrier assembly 68 is loaded into the top chase 70 of a molding tool 72 (step 106 in FIG. 18). The bottom chase 74 may be lined with a release film 76 if necessary or desirable to facilitate the subsequent release of the part from the molding tool. In FIG. 14, an epoxy or other suitable mold compound 78 is dispensed into bottom chase 74 (step 108 in FIG. 18) and, in FIG. 15, chases 72 and 74 are brought together as indicated by arrows 77 to form the in-process print bar assembly 79 shown in FIG. 16 (step 110 in FIG. 18). In FIG. 16, the in-process molded print bar assembly 79 is removed from molding tool 72 and channels 36 cut or otherwise formed in molding 26, as indicated generally by saw 81 and arrows 83 in FIG. 16 (steps 112 and 114 in FIG. 18). The in-process structure is released from carrier 64 in FIG. 17 (step 116 in FIG. 18). The printhead die slivers are connected to the PCB conductors to form print bar 12, for example by wire bonding as shown in FIG. 6 (step 118 in FIG. 18).

The order of execution of the steps in FIG. 18 may differ from that shown. For example, it may be desirable in some fabrication sequences to place the printhead dies on the carrier before placing the PCB on the carrier. Also, it may be desirable in some implementations to perform two or more steps concurrently. For example, it may be possible in some fabrication sequences to form the channels in step 114 concurrently with molding the parts in step 110.

FIG. 19 illustrates an ink cartridge 80 implementing one example of a new molded printhead assembly 82. FIGS. 20 and 21 are perspective front and back views, respectively, of the printhead assembly 82 in the ink cartridge 80 shown in FIG. 19. FIGS. 22-25 are detail and section views from FIGS. 19-21. Referring first to FIG. 19, ink cartridge 80 includes a molded printhead assembly 82 supported by a cartridge housing 84. Cartridge 80 is fluidically connected to an ink supply through an ink port 86 and electrically connected to a controller or other external circuitry through electrical contacts 88. Contacts 88 are formed in a so-called "flex circuit" 90 affixed to housing 84. Tiny wires (not shown) embedded in flex circuit 90, often referred to as traces or signal traces, connect contacts 88 to corresponding contacts 54 on printhead assembly 82. The front face of printhead assembly 82 is exposed through an opening 92 in flex circuit 90 along the bottom of cartridge housing 84.

Referring now also to FIGS. 20-25, printhead assembly 82 includes multiple printheads 14 each with printhead die slivers 34 embedded in a monolithic molding 26. Channels 36 formed in molding 26 carry printing fluid directly to the back part of corresponding printhead dies 34. As in the print bar example described above, PCB conductors 40 connect ejector and/or other elements in the IC part 44 of each die 34 to external contacts 54. In this example, however, the wire bonds connecting each die 34 to PCB conductors 40 are at the back part of the dies 34 and buried in molding 26. Also in this example, SMDs 28 are connected to PCB conductors with bond wires 48. As best seen in FIGS. 23 and 25, each bond wire 48 is buried in molding 26. "Back" part in this context means away from the front face of printhead assembly 82 so that the electrical connections can be fully encapsulated in molding 26. This configuration allows the front faces of dies 34, molding 26, and PCB 42 to form a single uninterrupted planar surface across the front face 94 of printhead assembly 82 in the printing area of printheads 14. This configuration allows mechanically robust connections that are largely protected from exposure to ink and, because there are no electrical connections along the front face of the die, the printhead can be made flat and thus minimize protruding structures that might interfere with printhead-to-paper spacing and/or capping and servicing.

"A" and "an" as used in the Claims means one or more.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A printing fluid cartridge comprising:

a housing; and an assembly supported by the housing and comprising:

a molding;

a fluid dispensing die having a front part comprising an orifice to dispense printing fluid from the fluid dispensing die, the fluid dispensing die embedded in the molding that comprises a channel to pass fluid to a back part of the fluid dispensing die, the front part of the fluid dispensing die exposed outside the molding and the back part of the fluid dispensing die covered by the molding except at the channel;

a first external electrical contact electrically connected to the fluid dispensing die and exposed outside the molding to connect to circuitry external to the assembly; and a non-fluid dispensing die electronic device buried in the molding and electrically connected to the first external electrical contact.

2. The printing fluid cartridge of claim 1, wherein:

a thickness of the molding varies from a lesser thickness around the fluid dispensing die to a greater thickness away from the fluid dispensing die; and the non-fluid dispensing die electronic device is buried in a thicker part of the molding.

3. The printing fluid cartridge of claim 2, wherein:

the assembly comprises a plurality of fluid dispensing dies and a plurality of external electrical contacts;

the molding comprises a single, monolithic molding comprising a plurality of channels each to pass fluid directly to the back part of one or more of the fluid dispensing dies; and each fluid dispensing die of the plurality of fluid dispensing dies is electrically connected to a respective external electrical contact of the plurality of external electrical contacts.

4. The printing fluid cartridge of claim 3, further comprising a printed circuit board embedded in the molding and wherein:

each fluid dispensing die of the plurality of fluid dispensing dies is connected to the respective external electrical contact through a conductor in the printed circuit board; and the non-fluid dispensing die electronic device is buried in the molding at a back part of the printed circuit board and is connected to the first external electrical contact through a conductor in the printed circuit board.

5. The printing fluid cartridge of claim 1, further comprising a port to fluidically connect to a printing fluid supply.

6. The printing fluid cartridge of claim 1, wherein the assembly comprises a plurality of external electrical contacts including the first external electrical contact, and the printing fluid cartridge further comprises a flex circuit affixed to the housing and comprising:

electrical contacts to connect to the circuitry external to the assembly; and traces to electrically connect the electrical contacts of the flex circuit to the external electrical contacts of the assembly.

7. The printing fluid cartridge of claim 6, wherein the flex circuit comprises an opening to expose a front portion of the assembly, the front portion comprising the fluid dispensing die.

8. The printing fluid cartridge of claim 1, further comprising a printed circuit board embedded in the molding, wherein the printed circuit board comprises:

an opening receiving the fluid dispensing die; and a surface on which the non-fluid dispensing die electronic device is mounted.

9. The printing fluid cartridge of claim 8, further comprising a printhead received in the opening, the printhead comprising the fluid dispensing die.

10. A printing fluid cartridge comprising:

an arrangement of fluid dispensing dies;

an electronic device at one end of the arrangement of fluid dispensing dies;

a monolithic molding covering the fluid dispensing dies and the electronic device such that fluid dispensing orifices at a front part of each fluid dispensing die are exposed outside the molding and a fluid inlet at a back part of each fluid dispensing die is exposed to a channel in the molding, a profile of the molding defining a narrower part along the fluid dispensing dies and a broader part at the electronic device; and a printed circuit board having conductors therein connected to the fluid dispensing dies and to the electronic device, the molding covering the printed circuit board such that the molding and the printed circuit board together form an exposed planar surface surrounding the fluid dispensing orifices at the front part of each of the fluid dispensing dies.

11. The printing fluid cartridge of claim 10, wherein a thickness of the molding at the broader part is greater than a thickness of the molding at the narrower part.

12. The printing fluid cartridge of claim 10, wherein:

the electronic device comprises an application specific integrated circuit mounted to a back surface of the printed circuit board;

the fluid dispensing orifices in the fluid dispensing dies are exposed at a front part of the molding; and the application specific integrated circuit is buried in a back part of the molding.

13. The printing fluid cartridge of claim 10, wherein each fluid dispensing die comprises a fluid dispensing die sliver, and the fluid dispensing die slivers are arranged along the molding in a staggered configuration in which a fluid dispensing die sliver overlaps an adjacent fluid dispensing die sliver.

14. The printing fluid cartridge of claim 10, wherein:

each fluid dispensing die is electrically connected to the printed circuit board through a connection outside the molding at a front part of the printed circuit board or through a connection inside the molding at a back part of the printed circuit board; and the electronic device is electrically connected to the printed circuit board through a connection inside the molding at the back part of the printed circuit board.

15. The printing fluid cartridge of claim 10, further comprising a housing and an assembly supported by the housing, the assembly comprising the arrangement of fluid dispensing dies, the electronic device, the monolithic molding, and the printed circuit board.

16. The printing fluid cartridge of claim 10, wherein the fluid dispensing dies are printhead dies, and the electronic device is a non-printhead die electronic device.

17. A printing fluid cartridge comprising:

a housing; and an assembly supported by the housing and comprising:

a monolithic molding;

a plurality of fluid dispensing dies, wherein each fluid dispensing die of the plurality of fluid dispensing dies has a front part comprising an orifice to dispense printing fluid, the plurality of fluid dispensing dies embedded in the monolithic molding that comprises channels to pass fluid to back parts of the fluid dispensing dies, the front parts of the fluid dispensing dies exposed outside the monolithic molding and the back parts of the fluid dispensing dies covered by the monolithic molding except at the channels;

a printed circuit board embedded in the molding and comprising conductors;

external electrical contacts electrically connected to the fluid dispensing dies through the conductors in the printed circuit board, the external electrical contacts exposed outside the monolithic molding to connect to circuitry external to the assembly; and an electronic device buried in the molding and electrically connected to an external electrical contact through a conductor in the printed circuit board, wherein a thickness of the monolithic molding around the electronic device is greater than a thickness of the monolithic molding around the fluid dispensing dies.

18. The printing fluid cartridge of claim 17, wherein a front part of the printed circuit board proximate the fluid dispensing dies is exposed outside the monolithic molding.

19. The printing fluid cartridge of claim 17, wherein the electronic device is buried in the monolithic molding at a back part of the printed circuit board.

* * * * *